US008628189B2

(12) United States Patent
Hokazono

(10) Patent No.: US 8,628,189 B2
(45) Date of Patent: Jan. 14, 2014

(54) INKJET RECORDING APPARATUS

(75) Inventor: Yutaka Hokazono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 13/216,605

(22) Filed: Aug. 24, 2011

(65) Prior Publication Data

US 2012/0050434 A1 Mar. 1, 2012

(30) Foreign Application Priority Data

Aug. 30, 2010 (JP) ..... 2010-192396

(51) Int. Cl.
*B41J 2/01* (2006.01)
*B41J 29/38* (2006.01)

(52) U.S. Cl.
USPC ..... 347/102; 347/17

(58) Field of Classification Search
None
See application file for complete search history.

(56) References Cited

U.S. PATENT DOCUMENTS 5,896,154 A * 4/1999 Mitani et al. ..... 347/102
7,184,700 B2 * 2/2007 Spilz et al. ..... 399/395
7,771,036 B2 * 8/2010 Ono ..... 347/96
2005/0168557 A1 * 8/2005 Ohyama ..... 347/104

FOREIGN PATENT DOCUMENTS

JP 7-178993 A 7/1995
JP 2004-106978 A 4/2004
WO 2004/094150 A1 11/2004

* cited by examiner

*Primary Examiner* — Stephen Meier
*Assistant Examiner* — Alexander C Witkowski
(74) *Attorney, Agent, or Firm* — Canon USA, Inc., I.P. Division

(57) ABSTRACT

An inkjet recording apparatus includes a conveying unit configured to convey a recording medium, a recording head configured to eject ink onto the recording medium conveyed by the conveying unit to perform recording, a platen configured to support the recording medium at a position facing the recording head, a heating unit configured to heat the recording medium on the downstream side of the platen in the conveying direction, and a plurality of protrusions that are disposed on the downstream side of the platen, wherein the plurality of protrusions are configured to contact the non-recording surface of the recording medium, and wherein the plurality of protrusions are arranged in the width direction of the recording medium. On the downstream side of the platen, the plurality of protrusions are configured to give a corrugated shape in the width direction to the recording medium expanded by being heated by the heating unit.

17 Claims, 10 Drawing Sheets

INKJET RECORDING APPARATUS

BACKGROUND OF THE INVENTION

1. Field of the Invention

The present invention relates to an inkjet recording apparatus having a unit configured to heat a recording medium for the fixation of ink on the downstream side of a recording portion.

2. Description of the Related Art

Recent inkjet recording apparatuses in the field of sign and display can handle coated paper, uncoated paper, cloth, vinyl chloride materials, and polyester materials as recording media, and can perform recording on a wide variety of materials. The inkjet recording apparatuses are used for various indoor and outdoor applications, such as outdoor signs, indoor graphics, and vehicle wrapping. In such inkjet recording apparatuses, high accuracy in image quality, high definition, and high-speed printing are required as well as water resistance and weather resistance.

This field is characterized in that ink is put on a recording medium and fixed by heating. A unit configured to heat a recording medium using a heating unit such as a heater to promote the fixation of ink is known. As a heating unit, a configuration provided with a preheater for preheating a recording medium before recording and an afterheater drying the recording medium after recording has been proposed (see International Publication No. 04/094150).

It is known that because recording media used in this field are expanded by heat, a corrugation in the conveying direction is formed in the image forming region. This corrugation leads to a decrease in image quality.

Corrugations formed in a recording medium in the image forming region include a corrugation caused by the soaking of ink into the recording medium and the swelling of the recording medium, and a corrugation caused by the expansion of the recording medium due to the heating for the fixation of ink.

As a countermeasure against the corrugation caused by the soaking of ink into the recording medium and the swelling of the recording medium, a configuration is known in which ribs at a constant pitch are disposed from the image forming region to a downstream portion in the recording medium conveying direction, and spurs are disposed in the downstream portion (see Japanese Patent Laid-Open No. 2004-106978). This evenly disperses the corrugation formed in the recording medium that continues to swell even after recording. In the recording region, the expansion of the recording medium is dispersed as a corrugation fitting into the gaps between the ribs, and the recording medium is prevented from grazing the recording head.

Corrugations formed by heating include a corrugation that is formed in the image forming region by the heating in the image forming region, and a corrugation that is formed in a fixation promoting region downstream of the image forming region by the heating in the fixation promoting region and that spreads to the image forming region.

A method for reducing the corrugation formed by heating a recording medium in the image forming region is known that includes sucking the reverse side of the recording medium through a flat platen surface.

As a countermeasure against the corrugation in a recording medium in a printer, Japanese Patent Laid-Open No. 7-178993 is known although this is in the field of thermal-transfer printers. According to this, the corrugation can be spread out by a convex roller located downstream of the image forming region. Thus, the corrugation in the image forming region can be removed.

In an inkjet recording apparatus that heats a recording medium in a fixation promoting region on the downstream side of the image forming region, the progression of evaporation of ink and the decrease in the amount of heat removed as heat of vaporization in the fixation promoting region promote the temperature rise of the recording medium. Because the amount of expansion of the recording medium increases with temperature, the recording medium expands significantly in the fixation promoting region, and one or several ridges are formed and spread to the recording region.

In the configuration of Japanese Patent Laid-Open No. 7-178993, the recording medium needs to be conveyed a predetermined distance in order to spread out the corrugation. Even if the corrugation formed in the image forming region can be regulated using a suction mechanism, the corrugation formed downstream of the image forming region when the roller is stopped cannot be removed. This decreases the image quality.

SUMMARY OF THE INVENTION

The present invention reduces influence of the spread of a corrugation formed in the fixation promoting region to the image forming region.

In an aspect of the present invention, an inkjet recording apparatus includes a conveying unit configured to convey a recording medium, a recording head configured to eject ink onto the recording medium conveyed by the conveying unit to perform recording, a platen configured to support the recording medium at a position facing the recording head, a heating unit configured to heat the recording medium on the downstream side of the platen in the conveying direction, and a plurality of protrusions that are disposed on the downstream side of the platen, wherein the plurality of protrusions are configured to contact the non-recording surface of the recording medium, and wherein the plurality of protrusions are arranged in the width direction of the recording medium. On the downstream side of the platen, the plurality of protrusions are configured to give a corrugated shape in the width direction to the recording medium expanded by being heated by the heating unit.

Further features of the present invention will become apparent from the following description of exemplary embodiments with reference to the attached drawings.

DESCRIPTION OF THE EMBODIMENTS

Figure 1:
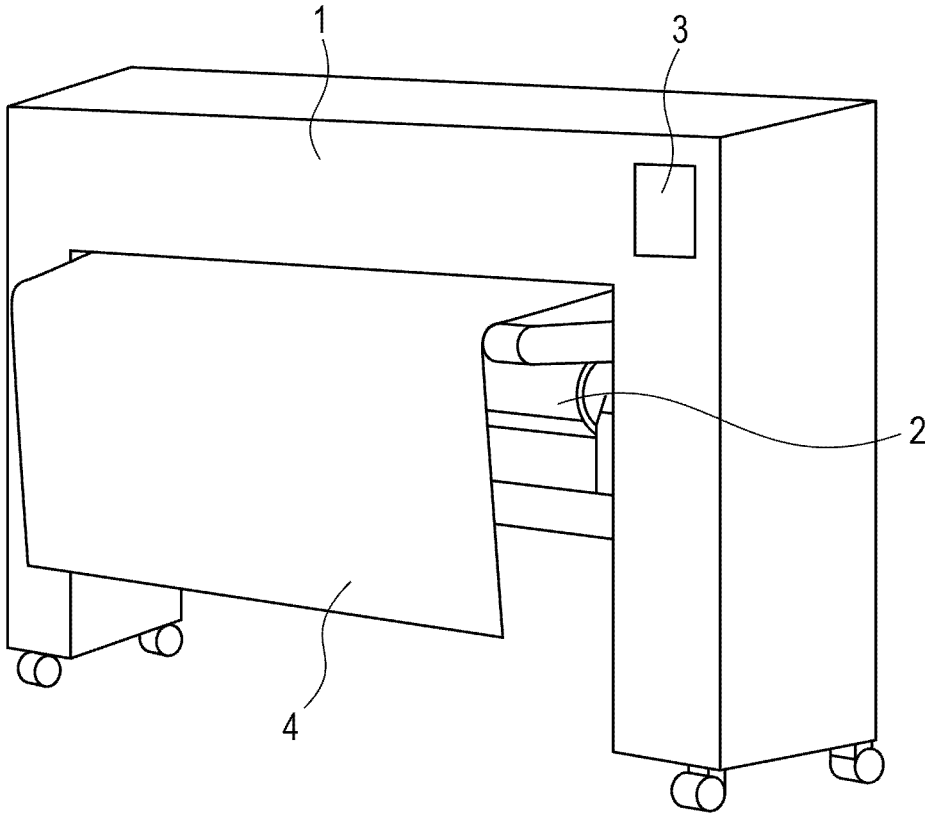
FIG. 1 is a perspective view of an inkjet recording apparatus according to a first embodiment of the present invention.

The preferred embodiments of the present invention will now be described with reference to the drawings. However, the components described in the embodiments are illustrative only, and the scope of the present invention is not limited thereto. In the drawings, the same reference numerals are used to designate the same or corresponding components.

FIG. 1 is a perspective view of an inkjet recording apparatus 1 (hereinafter referred to as "printer") to which the present invention is applied. Roll paper 2 is loaded in the printer 1 as a recording medium 4. The printer 1 has an operating portion 3 for operating the printer 1. Through various switches in the operating portion 3, the width of the roll paper 2, online/offline, commands, and the like are input.

Figure 2:
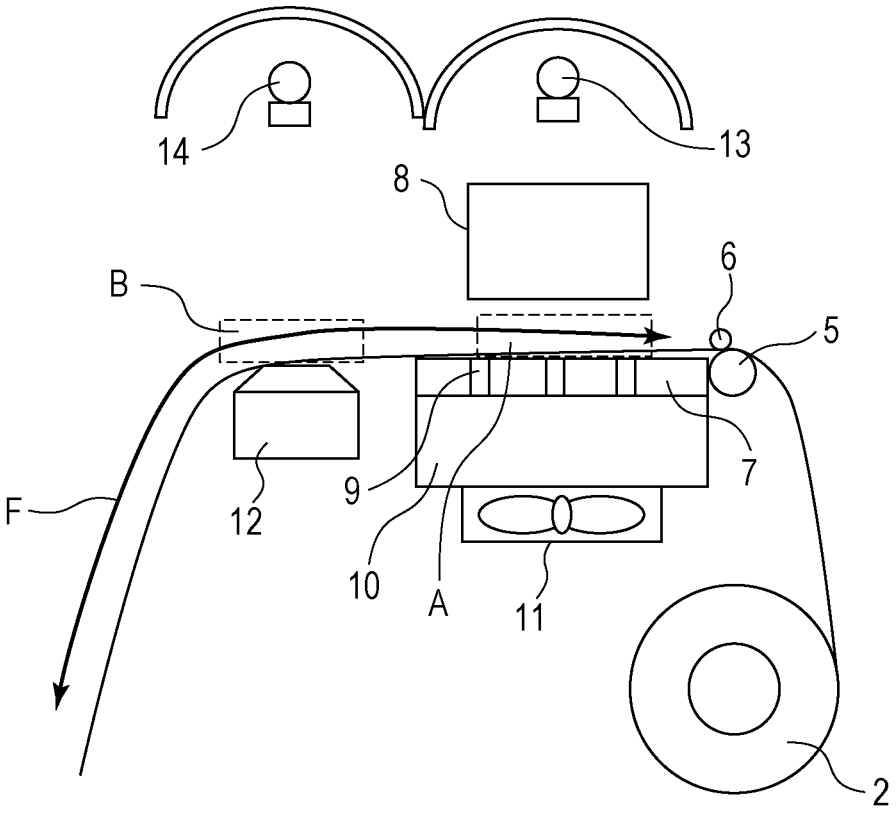
FIG. 2 is a sectional view of the inkjet recording apparatus.

FIG. 2 is a sectional side view of the printer 1. When the leading edge of the recording medium 4 is nipped between a conveying roller 5 and a pinch roller 6 that form a conveying unit, the printer 1 is ready for recording. At the start of recording, the recording medium 4 is conveyed by the conveying roller 5 onto a platen 7. At a position facing the platen 7, a recording head 8 that ejects ink is disposed and ejects ink onto the recording medium 4. The recording head 8 is mounted on a carriage (not shown) and reciprocates in a carriage scanning direction (a direction perpendicular to the direction in which the recording medium 4 is conveyed). The area A surrounded by a dotted line in FIG. 2 is an image forming region. Above the recording head 8, a first heater 13 (second heating unit) is disposed and preheats the recording medium 4. At this time, the recording medium is expanded by heat and corrugated.

The platen 7 has a supporting surface that is a flat surface that supports the recording medium. In the supporting surface, many suction holes 9 for attracting the recording medium 4 to the platen 7 using negative pressure are formed. Under the platen 7, a duct 10 in communication with the platen 7 is disposed. Under the duct 10, a suction fan 11 is disposed that is in communication with the duct 10 and generates negative pressure for attracting the recording medium 4 to the platen 7. By attracting the recording medium 4 to the platen 7 using negative pressure, corrugation can be reduced.

After the recording medium is conveyed on the downstream of the platen 7, the fixation of ink is promoted by a second heater 14 (heating unit). The area B surrounded by a dotted line in FIG. 2 is a fixation promoting region. In the fixation promoting region, a sliding contact member 12 is disposed that is in sliding contact with the reverse side (non-recording surface) of the recording medium 4. The temperature of the recording medium is increased by the second heater 14 as the recording medium is conveyed downstream. With progression of evaporation of the vehicle of ink, the amount of heat removed as heat of vaporization decreases, and the temperature of the recording medium 4 rises significantly. Because the amount of expansion of the recording medium increases with temperature, the recording medium expands significantly and a corrugation is formed. The weight of the part of the recording medium hanging on the downstream side of the sliding contact member 12 subjects the recording medium in the image forming region and the fixation promoting region to tension in the conveying direction. In the fixation promoting region, the corrugation of the recording medium 4 is dispersed by the tension on the recording medium 4 and a plurality of protrusions of the sliding contact member 12. Therefore, the sliding contact member 12 is disposed on the downstream side of the platen 7 and right under the second heater 14. Between the sliding contact member 12 and the platen 7, a nonbinding region where nothing is in contact with the recording medium is formed.

After an image is recorded on the recording medium 4, the recording medium 4 is ejected by a conveying roller 5 and cut at a desired position on the trailing edge of the recorded image. For cutting the recording medium 4, the printer 1 may be provided with an automatic cutting unit (not shown).

Figure 3:
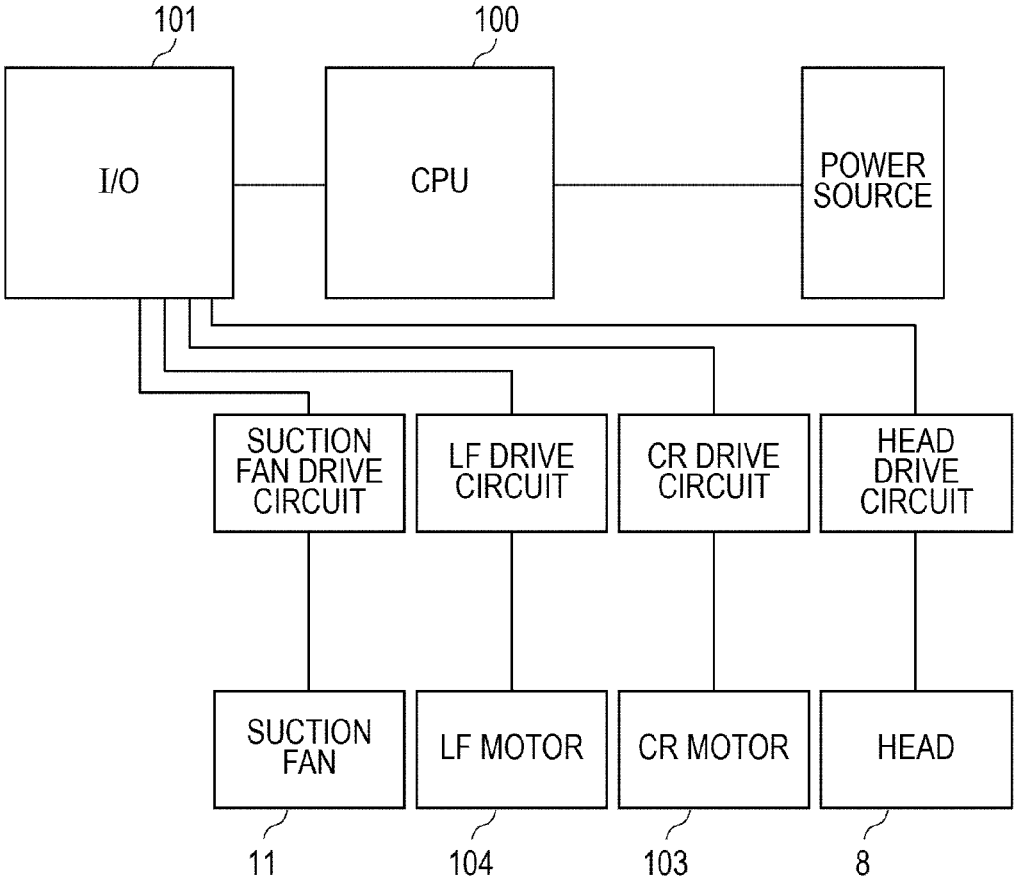
FIG. 3 is a block diagram of a main body control circuit of the inkjet recording apparatus.
Figure 4:
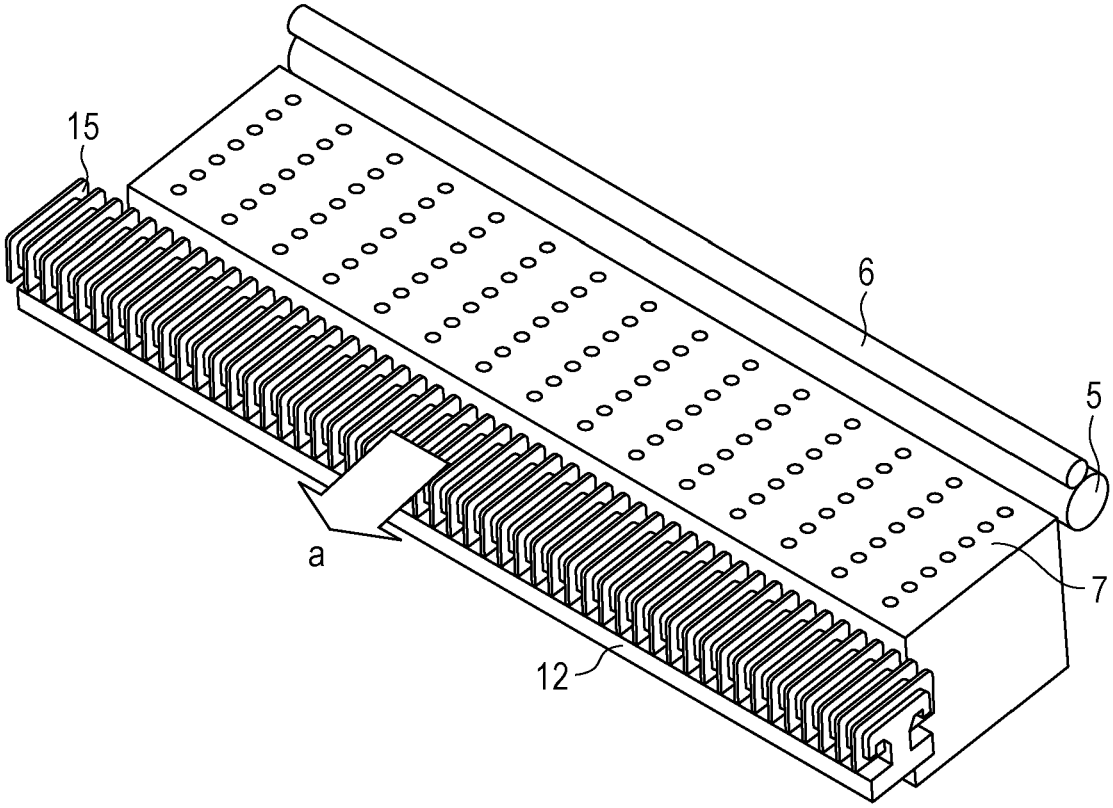
FIG. 4 is a perspective view of the main part of the inkjet recording apparatus.

FIG. 3 is a main body control block diagram. After a main body CPU 100 receives image data from a host PC, the carriage scanning speed, the number of paper feed passes, and the suction fan duty are determined according to the image quality. At this time, information on whether bordered print or borderless print is performed, and information on whether roll paper or cut paper is used are also transmitted together with the image data from the PC. Next, the sliding contact member 12, which is the characterizing portion of the present invention, will be described with reference to FIGS. 4 and 5.

Figure 5:
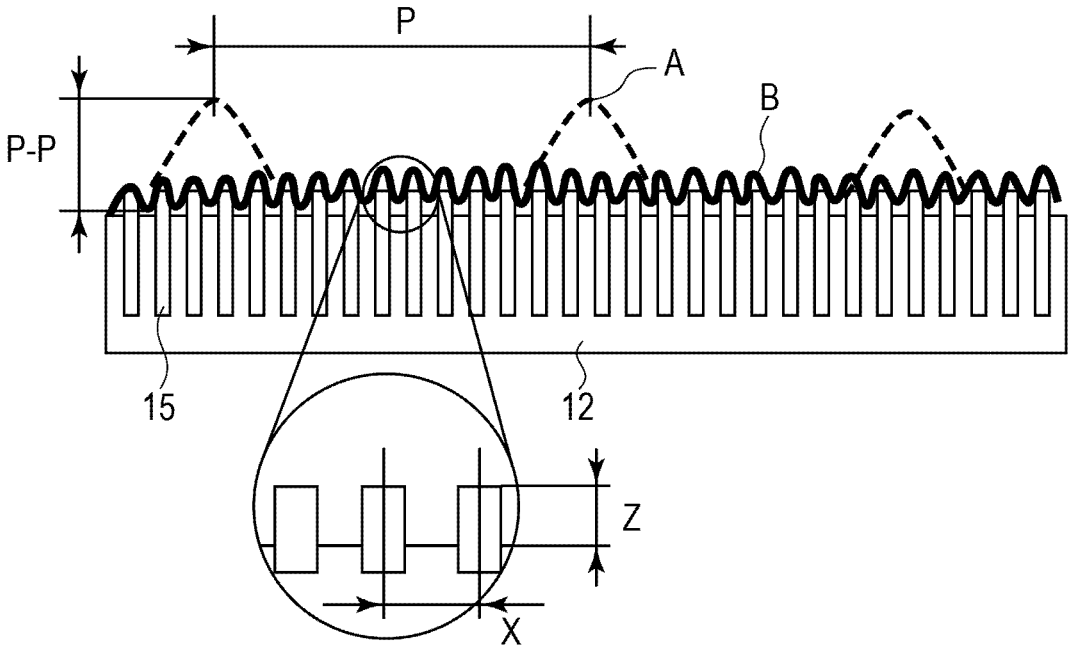
FIG. 5 shows the main part of a sliding contact member related to the first embodiment.

The pitch P in the carriage scanning direction of a corrugation formed in the recording medium by being heated by the first heater 13 and the second heater 14 in the case where the sliding contact member 12 is not used will be referred to as "corrugation pitch" P (see the dotted line in FIG. 5). The distance between the upper limit and the lower limit of the conventional corrugation will be referred to as "corrugation amplitude" P-P (FIG. 5, dotted line A). When they are used in the claims, they have the same meanings.

The sliding contact member 12 has many protrusion ribs 15 arranged in the width direction of the recording medium. The protrusion ribs 15, which are protrusions, extend in the conveying direction and are disposed in the carriage scanning direction at a constant pitch (hereinafter referred to as "protrusion rib pitch," see FIG. 5). The protrusion ribs 15 have a constant depth Z (hereinafter referred to as "protrusion rib depth," see FIG. 5). The recording medium 4 is conveyed in the direction "a" in FIG. 4. After passing over the sliding contact member 12, the recording medium 4 hangs under its own weight in the direction of gravitational force. At this time, the part of the recording medium between the nip between the conveying roller 5 and the pinch roller 6 and the leading edge of the recording medium is subjected to a predetermined tension due to its own weight in the conveying direction (F in FIG. 2). The sliding contact member 12 needs to be placed so as to overlap the recording medium conveying path so that the recording medium under the predetermined tension presses the sliding contact member 12. As described above, the sliding contact member 12 is disposed right under the second heater 14 or on the upstream side thereof.

The height of the protrusion ribs 15 is lower than the recording medium supporting surface of the platen 7 in order to ensure the contact between the recording medium and the platen 7.

The recording medium 4 in sliding contact with the sliding contact member 12 is fitted into the gaps between the protrusion ribs 15 by a predetermined pressure. As a result, a high-frequency corrugation having the same pitch as the protrusion rib pitch X is formed (FIG. 5, solid line). In the conventional printers, a corrugation having a large amplitude and a low frequency has been prone to be formed (FIG. 5, dotted line A). The pitch of the corrugation is denoted by P in FIG. 5. By using a predetermined tension and the sliding contact member 12, a corrugation having a small amplitude and a high frequency (FIG. 5, solid line B) can be formed in the width direction of the recording medium. The corrugation affecting the image quality can be prevented from spreading to the image forming region.

Empirically, when the amplitude P-P of the corrugation formed in the fixation promoting region is 1 mm or more, image unevenness is prone to occur. It is empirically known that in that case, the pitch P of the corrugation formed in the recording medium 4 is about 20 mm. In view of this point, when the depth Z of the protrusion ribs is larger than 1 mm and the pitch X of the protrusion ribs is smaller than 20 mm, the influence on the image forming region can be prevented. Such a shape that Z is larger than or equal to 0.5 mm and X is smaller than or equal to 10 mm is one of the best shapes for reducing image unevenness.

For example, when recording is performed on a recording medium 4 having a width (length in the carriage scanning direction) of 1 m, the part of the recording medium 4 near the sliding contact member 12 needs to be subjected to a tension of 0.3 kg or more. If the tension is lower than 0.3 kg, the pressure applied by the recording medium 4 to the protrusion ribs 15 is insufficient, and the recording medium 4 may not be sufficiently fitted into the gaps between the protrusion ribs 15.

Figure 6A:
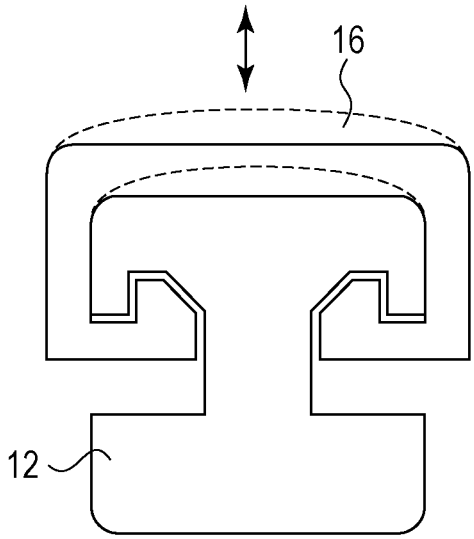
FIGS. 6A and 6B show the main part of a sliding contact member related to the first embodiment.
Figure 6B:
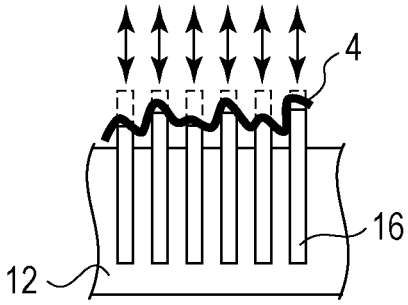
Figure 7A:
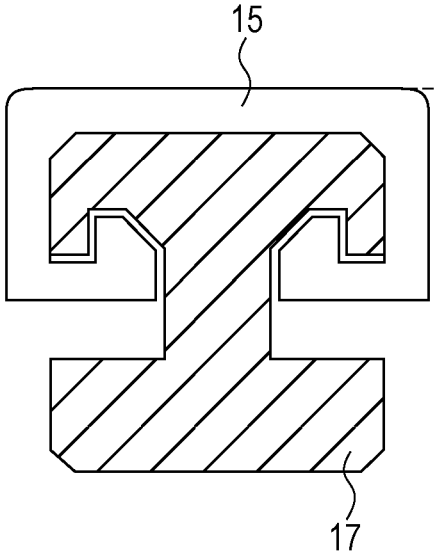
FIGS. 7A and 7B show the main part of a sliding contact member related to the first embodiment.
Figure 7B:
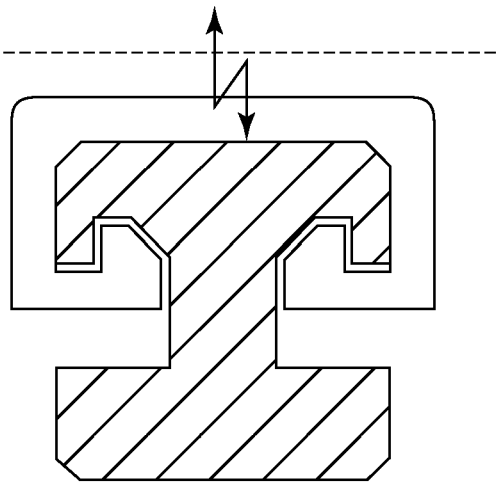

If protrusion ribs 16 that are deformable elastic bodies are provided on the sliding contact member 12 as shown in FIG. 6A, the protrusion ribs 16 can easily follow the corrugation in the recording medium 4 as shown in FIG. 6B. The sliding contact between the recording medium 4 and the sliding contact member 12 is further stabilized. As shown in FIGS. 7A and 7B, the portion 17 supporting the protrusion ribs 15 may be formed of a spongy material. The same advantageous effect can be obtained. Specifically, following the corrugation formed in the recording medium, the protrusion ribs 15 move up and down as shown in FIGS. 7A and 7B. Alternatively, an elastic member may be interposed between the protrusion ribs 15 and the portion supporting the protrusion ribs 15 so that the protrusion ribs 15 can move when pressed by the recording medium 4.

Figure 8:
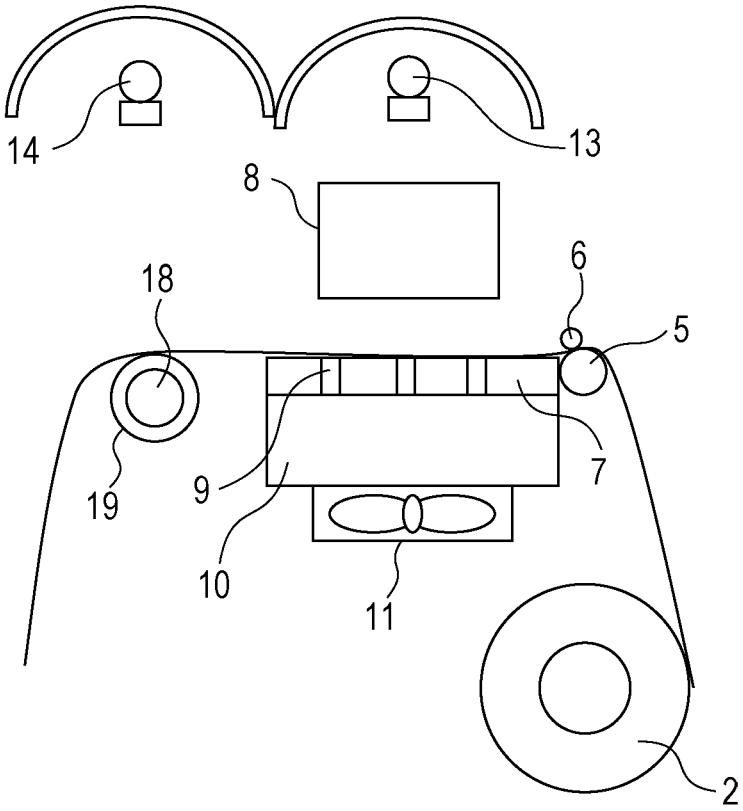
FIG. 8 is a sectional view of an inkjet recording apparatus related to the first embodiment.
Figure 9:
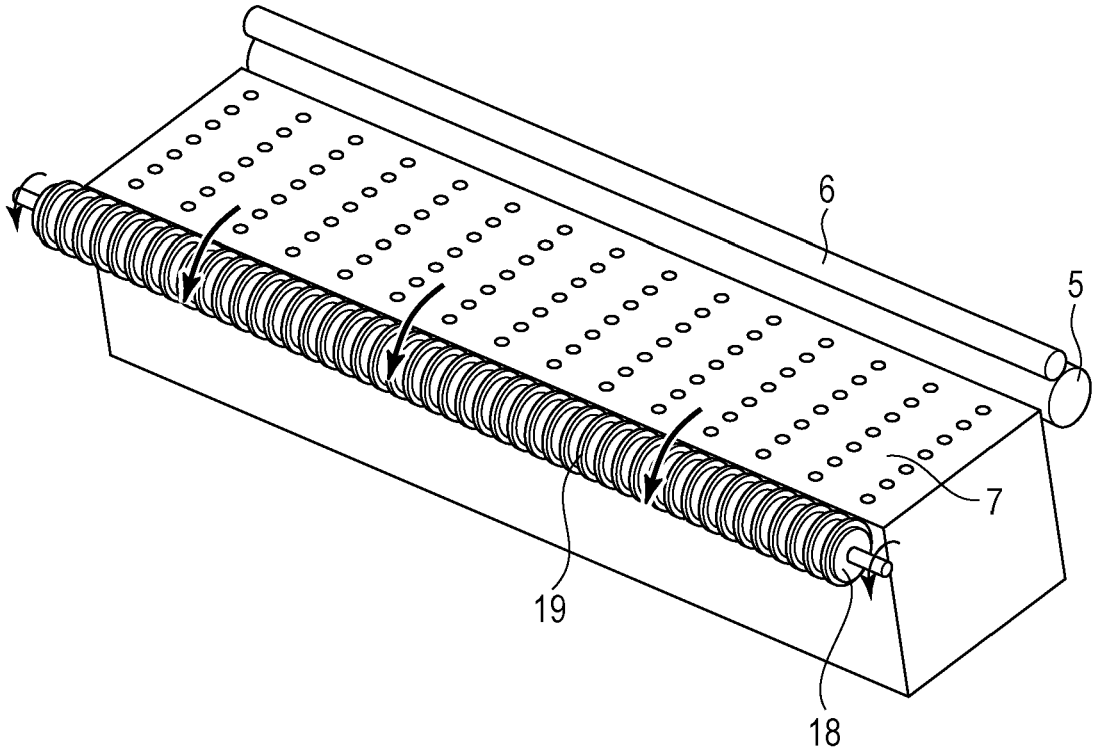
FIG. 9 is a perspective view of the main part of the inkjet recording apparatus related to the first embodiment.

As shown in FIGS. 8 and 9, instead of the sliding contact member 12, a sliding contact roller 18 in sliding contact with the reverse side of the recording medium 4 may be placed downstream of the platen 7 in the conveying direction. The sliding contact roller 18 has protrusion ribs 19 disposed in the longitudinal direction of the roller at regular intervals. The sliding contact roller 18 and the protrusion ribs 19 can be rotated by the recording medium 4 being conveyed. Thus, a corrugation having a small amplitude and a high frequency can be formed on the recording medium 4, and the decrease in conveyance accuracy due to the increase in resistance to conveyance of the recording medium 4 can be prevented. Alternatively, only the protrusion ribs 19 may be rotated by the recording medium 4 being conveyed.

According to this embodiment, a recording medium under a predetermined tension presses a sliding contact member 12, and the recording medium is fitted into the gaps between protrusion ribs. The corrugation in the conveying direction formed in the recording medium by the heater locating in the fixation promoting region has a small amplitude and a high frequency. The corrugation does not spread to the image forming region locating upstream in the conveying direction. Thus, the image quality can be maintained.

Removing the corrugation formed in the recording medium can prevent a breakage of the recording head, a recording medium jam in the conveying path, and a decrease in recording medium conveyance accuracy. A sufficient effect can be obtained only by bringing the recording medium into sliding contact with the sliding contact member with the weight of the recording medium. In the case of a light-weight recording medium, a high-frequency corrugation can be ensured by increasing the tension on the recording medium using a take-up unit. Thus, a constant image quality can be maintained regardless of the type of recording medium.

By making the protrusion ribs able to be moved by the reverse side of the recording medium, the recording medium can be stably slid on the protrusion ribs. Thus, a high-frequency corrugation can be formed regardless of the type of recording medium.

The sliding contact member or many protrusion ribs provided on the sliding contact member are rotated by the recording medium being conveyed, and conveyance resistance due to sliding contact can thereby be reduced. Thus, the recording medium conveyance accuracy can be maintained.

Second Embodiment

Figure 10:
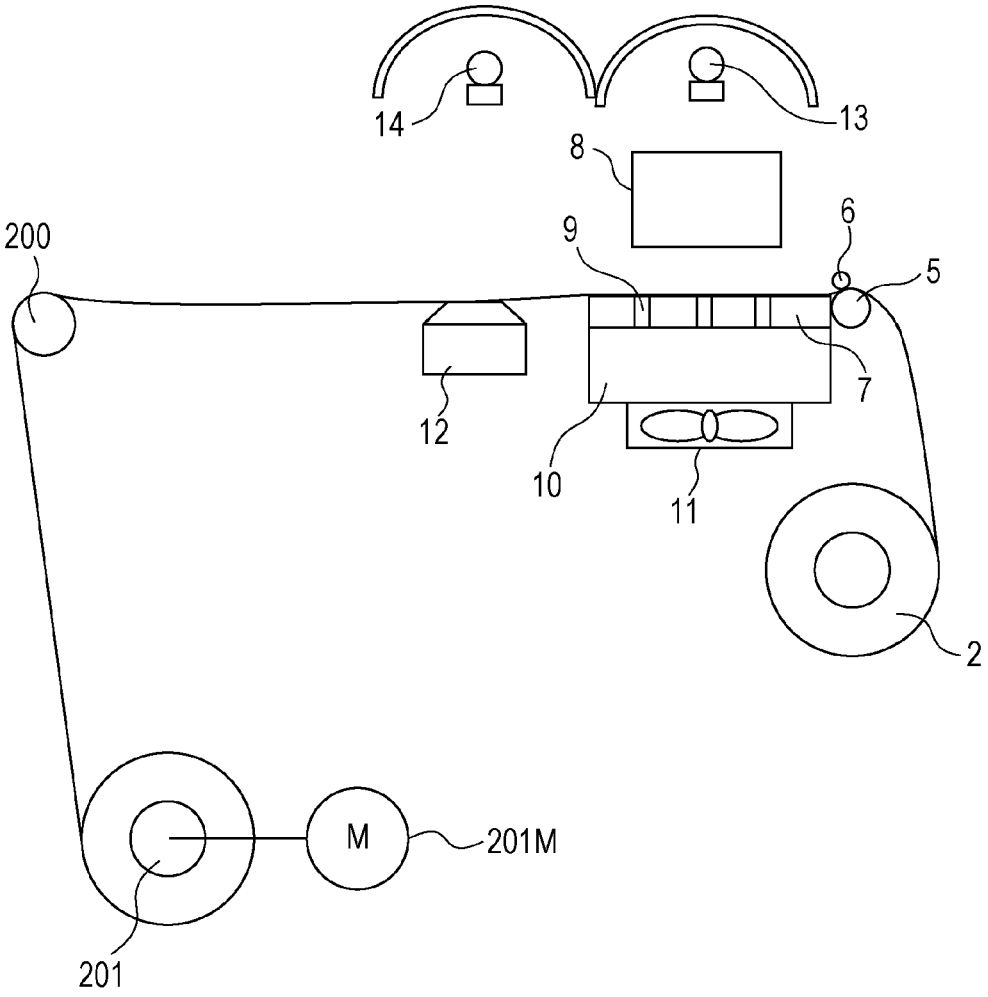
FIG. 10 is a sectional view of an inkjet recording apparatus related to a second embodiment.

FIG. 10 is a sectional side view of a printer. The basic configuration of this printer is the same as that of the printer shown in FIG. 2. The differences from the printer shown in FIG. 2 will be described below.

In this configuration, before recording, the leading end of the recording medium 4 is preliminarily wound on a take-up roller 201 that is a take-up unit. At this time, the recording medium 4 is wound on the take-up roller 201 via a sliding contact member 12 and a turn roller 200. When recording is started, a motor 201M gives torque to the take-up roller 201 in the take-up direction. The take-up torque acting on the take-up roller 201 subjects the part of the recording medium from the nip between a conveying roller 5 and a pinch roller 6 to the take-up roller 201 to forcible tension in the conveying direction. Whereas the first embodiment is less effective for a light-weight recording medium 4, this embodiment is effective for any type of recording medium because a predetermined tension is forcibly generated.

The sliding contact member 12 may include protrusion ribs 16 formed of an elastic material or may be a sliding contact roller 18 as in the first embodiment. The tension in the conveying direction on the recording medium is, as in the first embodiment, empirically 0.3 kg or more in the case where the width (the length in the carriage scanning direction) of the recording medium is 1 m. If the tension is lower than 0.3 kg, the pressure applied by the recording medium 4 to the protrusion ribs 15 is insufficient, and the recording medium 4 may not be sufficiently fitted into the gaps between the protrusion ribs 15.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-192396 filed Aug. 30, 2010, which is hereby incorporated by reference herein in its entirety.

What is claimed is:

1. An inkjet recording apparatus comprising:

a conveying unit configured to convey a recording medium in a conveying direction;

a recording head configured to eject ink onto the recording medium conveyed by the conveying unit to perform recording;

a platen configured to support the recording medium at a position facing the recording head;

a heating unit configured to heat the recording medium on the downstream side of the platen in the conveying direction, wherein the recording medium onto which the ink has been applied by the recording head expands by being heated by the heating unit; and a plurality of protrusions that are disposed in a region where the heating unit supplies heat, wherein the plurality of protrusions are configured to contact a non-recording surface of the recording medium, and wherein the plurality of protrusions are arranged in a width direction of the recording medium, wherein on the downstream side of the platen, the plurality of protrusions are configured to give a corrugated shape in the width direction to the recording medium expanded by being heated by the heating unit.

2. The inkjet recording apparatus according to claim 1, wherein the plurality of protrusions are ribs extending in the conveying direction.

3. The inkjet recording apparatus according to claim 2, wherein the ribs are disposed at a position either facing the heating unit or on the upstream side of the heating unit.

4. The inkjet recording apparatus according to claim 1, wherein the recording medium is subjected to tension in the conveying direction such that the recording medium is pressed against the protrusions.

5. The inkjet recording apparatus according to claim 4, wherein the plurality of protrusions are formed of an elastic material so as to be able to be deformed by being pressed by the recording medium.

6. The inkjet recording apparatus according to claim 4, wherein the plurality of protrusions are supported by an elastic member so as to be able to be moved by being pressed by the recording medium.

7. The inkjet recording apparatus according to claim 4, wherein the recording medium is subjected to tension in the conveying direction, the recording medium presses the plurality of protrusions owing to the tension, and the recording medium is fitted into the gaps between the protrusions.

8. The inkjet recording apparatus according to claim 4, wherein the recording medium is tensioned by its own weight.

9. The inkjet recording apparatus according to claim 1, wherein the protrusions are in contact with the recording medium at a position lower than a supporting surface with which the platen supports the recording medium.

10. The inkjet recording apparatus according to claim 1, further comprising a region where nothing is in contact with the recording medium between the protrusions and the platen.

11. The inkjet recording apparatus according to claim 1, wherein a supporting surface with which the platen supports the recording medium is a flat surface.

12. The inkjet recording apparatus according to claim 1, further comprising a suction fan configured to attract the recording medium to the platen.

13. The inkjet recording apparatus according to claim 1, further comprising a second heating unit configured to heat the recording medium and disposed above the platen.

14. The inkjet recording apparatus according to claim 1, further comprising a take-up unit configured to take up a part of the recording medium on which recording has been performed while subjecting the part of the recording medium to tension in the conveying direction.

15. The inkjet recording apparatus according to claim 1, wherein the plurality of protrusions can be rotated by the recording medium being conveyed.

16. The inkjet recording apparatus according to claim 1, wherein the plurality of protrusions are a plurality of ribs extending in the conveying direction, and the plurality of ribs are disposed in the scanning direction of the recording head at a constant pitch.

17. The inkjet recording apparatus according to claim 1, wherein the pitch of the protrusions is shorter than the pitch of corrugation formed in the recording medium by being heated by the heating unit.

* * * * *